US006185824B1

(12) United States Patent
McClure et al.

(10) Patent No.: US 6,185,824 B1
(45) Date of Patent: Feb. 13, 2001

(54) METHOD OF INSTALLING PANEL CLOSURES ON METAL ROOF PANELS

(75) Inventors: Richard R. McClure, Bashor, KS (US); Alan Richard Boell, Blue Springs, MO (US)

(73) Assignee: Butler Manufacturing Company, Inc., Kansas City, MO (US)

( * ) Notice: Under 35 U.S.C. 154(b), the term of this patent shall be extended for 0 days.

(21) Appl. No.: 09/291,749

(22) Filed: Apr. 14, 1999

Related U.S. Application Data

(62) Division of application No. 08/922,367, filed on Sep. 3, 1997, now abandoned.

(51) Int. Cl.[7] ..... B26B 13/06

(52) U.S. Cl. ..... 30/229; 52/749.1; 52/DIG. 1; 83/620; 83/693

(58) Field of Search ..... 52/749.1, DIG. 1; 30/230, 229, 233, 178, 363, 364, 368; 83/602, 620, 191, 693, 917

(56) References Cited

U.S. PATENT DOCUMENTS

| | | | | |
|---|---|---|---|---|
| 1,985,862 | * | 12/1934 | Kronquest | 30/233 |
| 2,969,754 | * | 1/1961 | Wilson | 52/DIG. 1 |
| 4,446,623 | * | 5/1984 | Stubbersfield et al. | 30/229 |
| 5,483,746 | * | 1/1996 | Beyers | 52/749.1 |

* cited by examiner

*Primary Examiner*—Richard Chilcot
(74) *Attorney, Agent, or Firm*—Shoemaker and Mattare, Ltd.

(57) ABSTRACT

Notches are cut in a "Z"-section closure to be installed across seams on a standing seam metal roof by means of a tool which punches holes in the central web of the closure. The lower flange of the closure is subsequently cut manually to finish the notch. The tool's die surfaces correspond in shape to that of the closure, and the punch and die are aligned so that the elongate hole they make in the central web extends to the bottom of the web.

5 Claims, 8 Drawing Sheets

METHOD OF INSTALLING PANEL CLOSURES ON METAL ROOF PANELS

This application is a division of application Ser. No. 08/922,367, filed Sep. 3, 1997, now abandoned.

BACKGROUND OF THE INVENTION

This invention relates to metal roof construction.

Where a metal panel roof is interrupted by an opening for a skylight or the like, the perimeter of the opening is framed with "closure" members to reinforce the opening and to provide a weather seal around the opening. The closure member may be made from "Z"-section channel stock.

Panel closures are usually installed by one of the following methods:

1. Factory formed panel closures, cut to about panel length at the factory, are fitted to the panel seam shape and then each individual closure is installed. Problems associated with this method are (a) the cost of tooling to manufacture each individual closure part, (b) the fact that one standard closure part will not work on hip conditions (e.g., where diagonal cuts varying in length are required), and (c) the finished installation is typically not as with straight as when a longer closure that spans numerous panels (i.e., a closure ten or twelve feet long). This method requires more parts, making the system more time consuming to install.
2. Nominal length closures (ten or twelve feet long) are field cut to fit across a panel, and tabs are field formed to the panel shape; then each individual panel closure is installed. The problem with this method is high labor cost resulting from the time needed to hand cut and then form each panel. Like the previous method, the finished installation is typically not as straight as possible. Also, the fit-up of the field notching is usually not very accurate.
3. Nominal length closures are field notched with hand snips to fit over several panel seams and then the full length piece is installed. The principal difficulty with this method is that of cutting the required shape around each panel corrugation with hand snips. Depending on the panel shape, it may be impossible to notch the closure member only with snips. Drilling or punching or chiseling may be required. Inaccuracies in field cutting may lead to leakage, and in any event, custom notching by hand is time consuming.

The proposed new method permits the use of long ten or twelve foot "Z"-section closures with the accuracy of a factory cut notch, but the notching can be performed in the field with a special hand tool. This tool punches out the corrugation shape from the vertical web of the closure, where it is difficult to snip by hand, but permits hand snipping the bottom flange at any angle desired, so that closures can be installed at non-perpendicular angles to the seams, for example on hip roofs.

SUMMARY OF THE INVENTION

An object of the invention is to enable workers to custom-install long closures on standing seam roofs in the field, using only stock material of standard lengths.

Another object is to improve the accuracy and neatness of field-cut notches in "Z"-section closures in the field.

A further object is to minimize the material and labor costs associated with closure installation.

According to this invention, a long "Z"-section closure is installed on a standing seam roof by steps of (a) marking seam locations on the closure, (b) punching slots out of the web of the closure at the marked locations, (c) cutting the bottom flange of the closure to meet the slot, along a direction according to the orientation of the seams with respect to the closure, and (d) installing the closure over the seams. The punching step is accomplished with a tool specifically designed for a Z-section workpiece.

BRIEF DESCRIPTION OF THE DRAWINGS

In the accompanying drawings.

DESCRIPTION OF THE PREFERRED EMBODIMENTS

Figure 1:
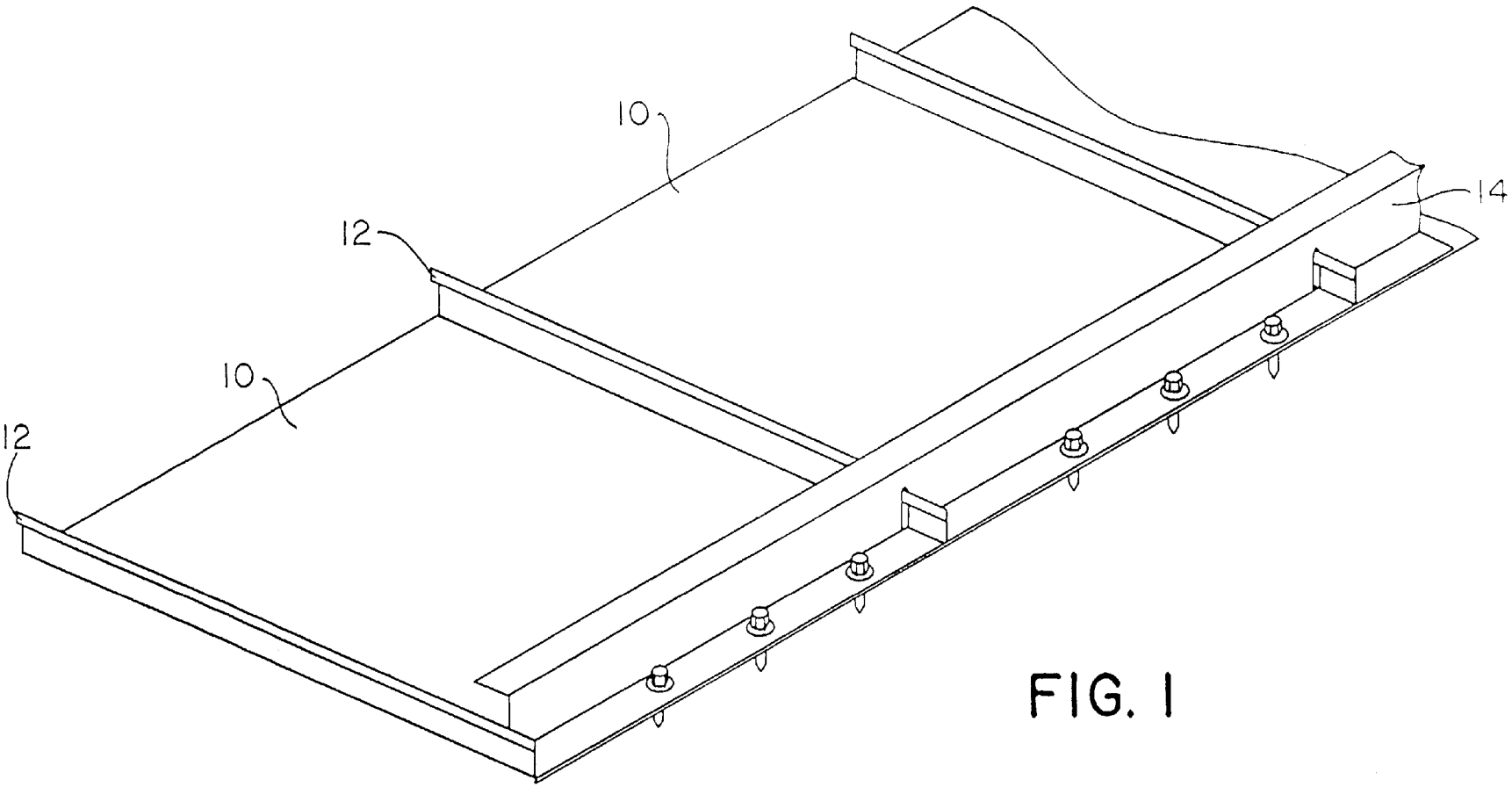
FIG. 1 is an isometric view of a panel closure installed on a roof by a method embodying the invention.
Figure 2:
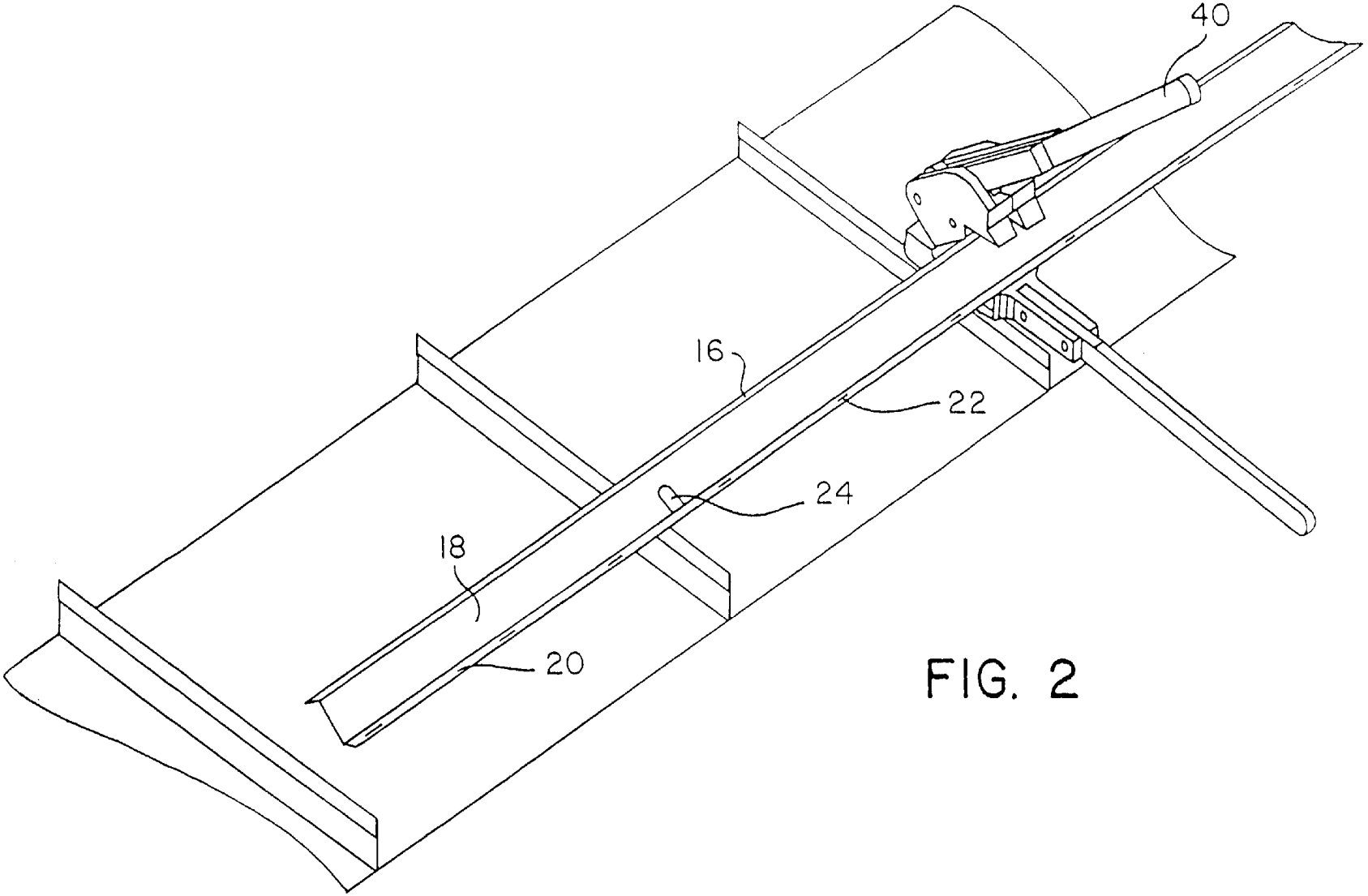
FIG. 2 is an isometric view showing a closure being punched with holes designed to fit over standing seams in a metal roof.

As one can see in FIG. 1, a standing seam metal roof fitted with a closure according to the invention is formed from a number of adjacent panels 10 interconnected along their edges by standing seams 12.

Figure 4:
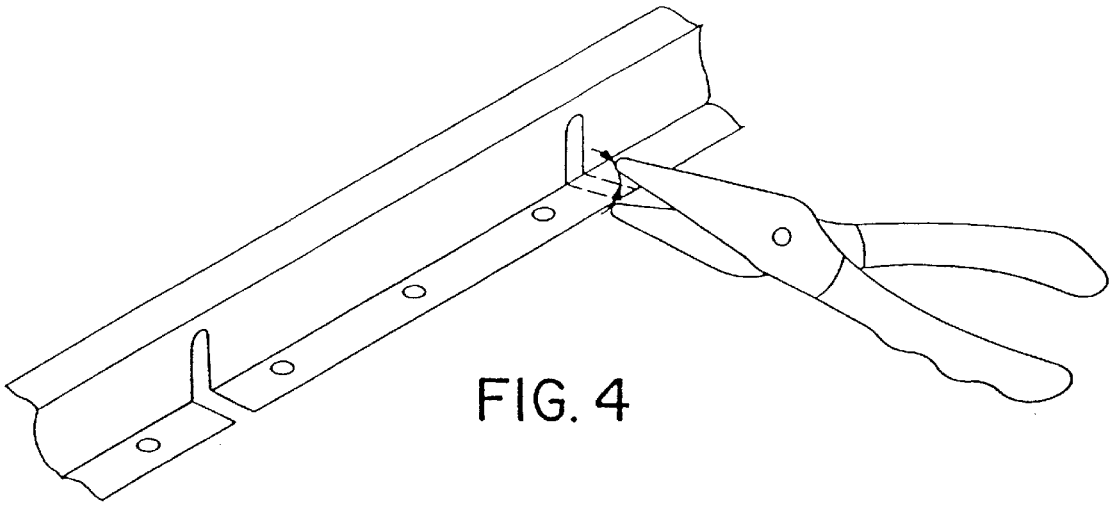
FIG. 4 is a view, like FIG. 3, of the bottom flange being cut on a diagonal to receive the seams of a hip roof.
Figure 5:
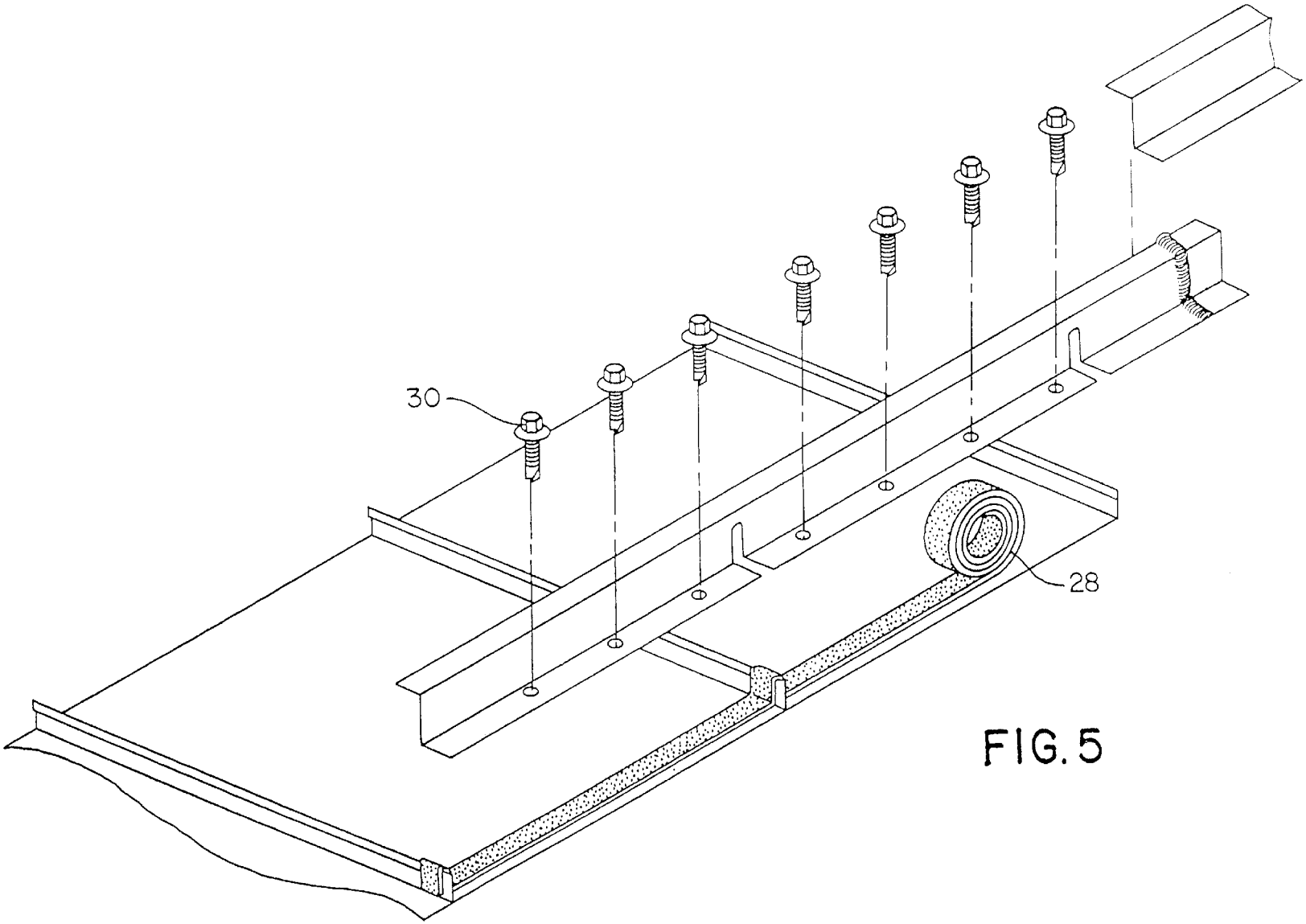
FIG. 5 shows the closure of FIG. 3 being installed on the roof.
Figure 6:
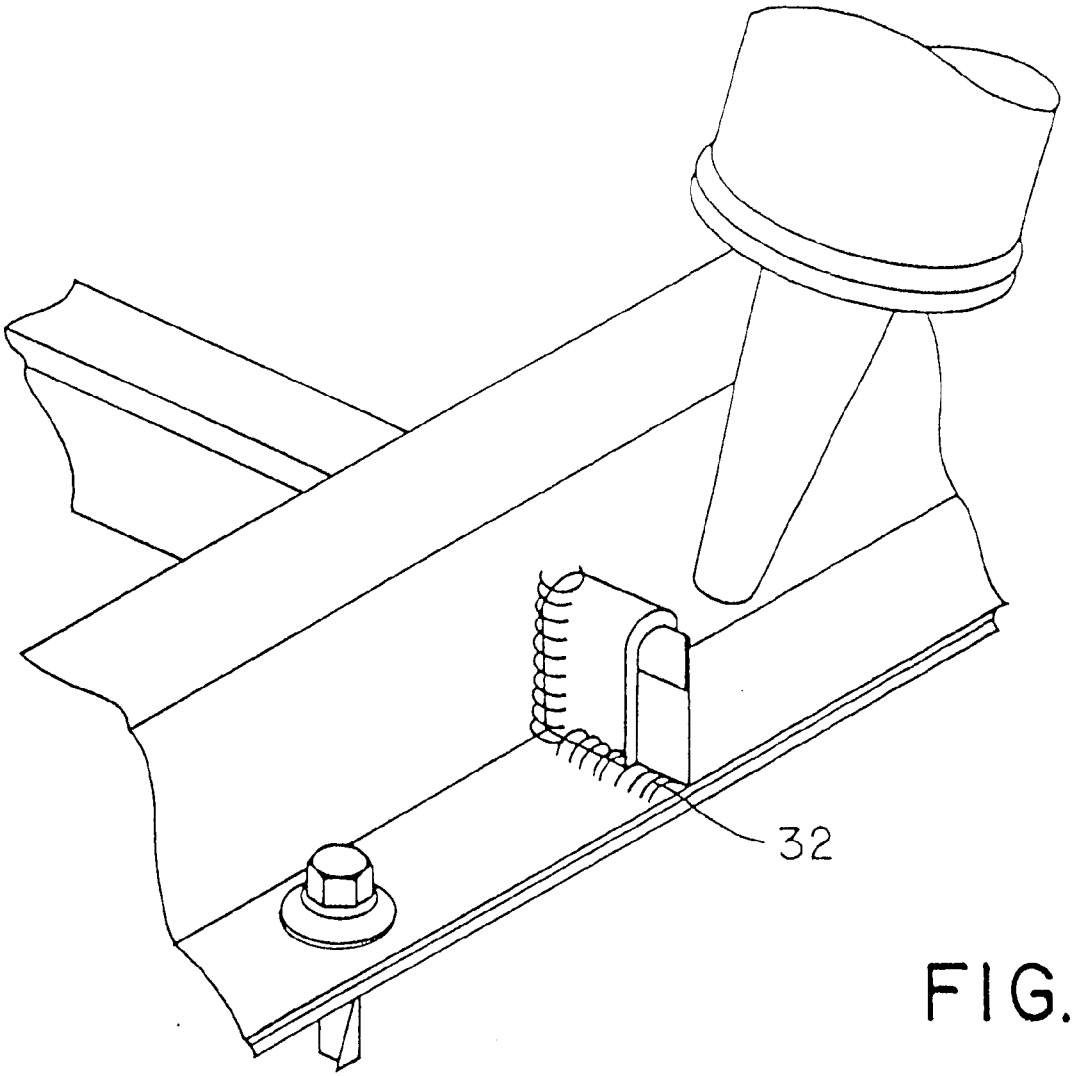
FIG. 6 shows the installed closure being caulked around the standing seam extending through it.
Figure 7:
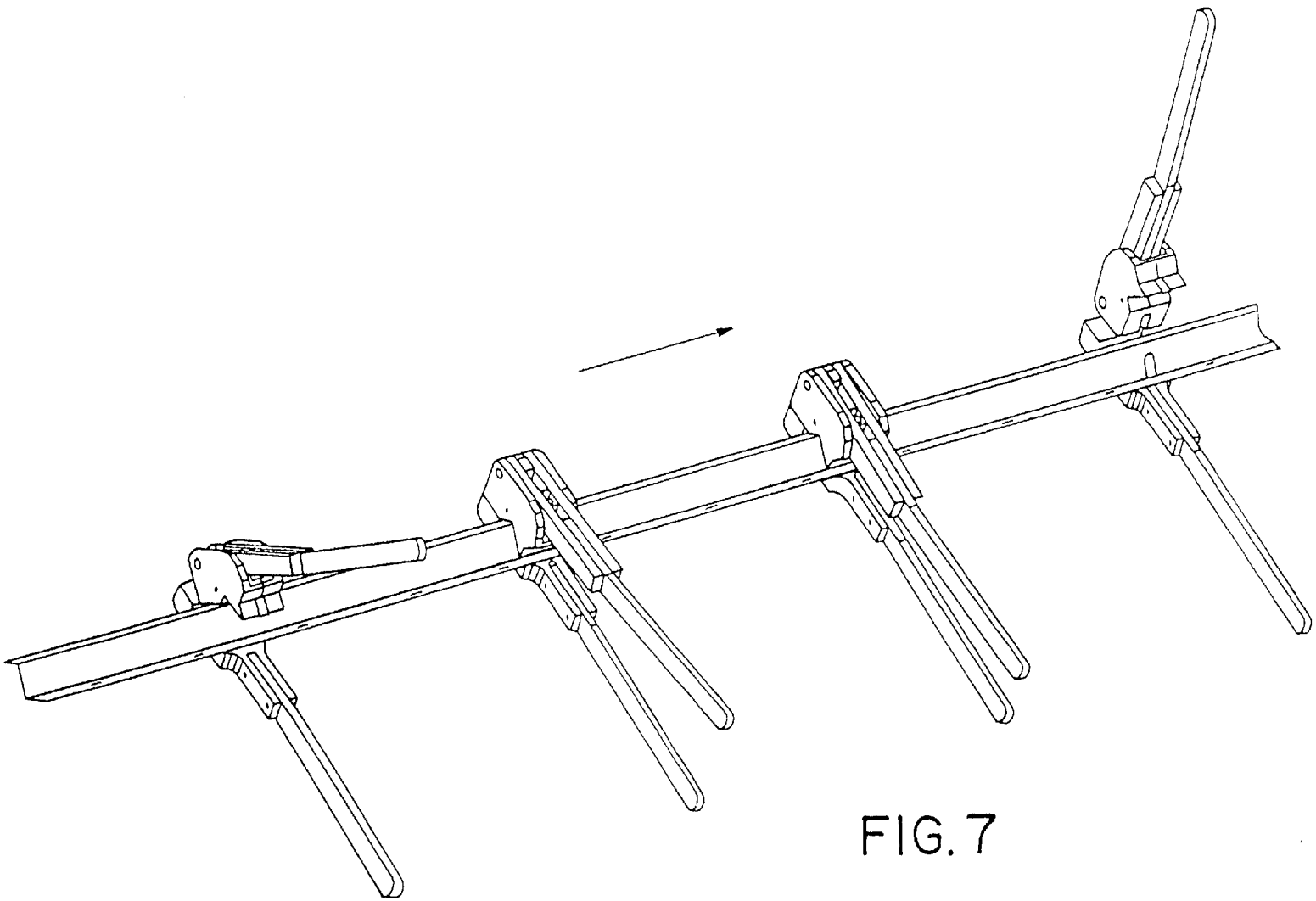
FIG. 7 shows a sequence in which the hole is punched in the center web of the closure.
Figure 8:
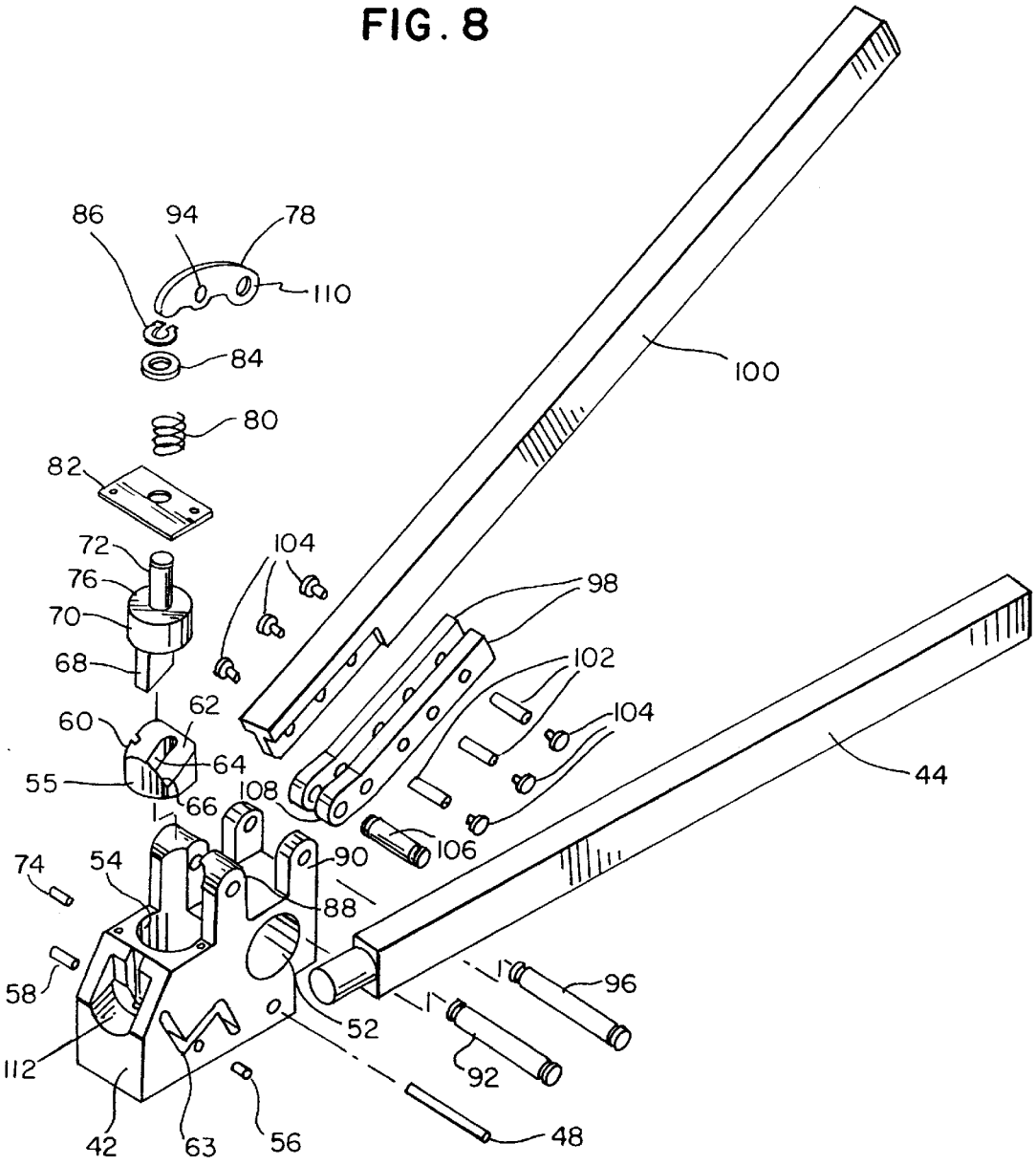
FIG. 8 is an exploded isometric view of the tool shown in FIG. 7.

In order for a closure 14 to be installed, the closure has to be notched to accept the seams, because the seams cannot be interrupted without destroying the integrity of the roof. Using the method of this invention, the notches are formed at the work site in nominal length Z-section metal stock. Whether the seams pass perpendicularly through the closures, as in FIG. 1, or diagonally, as in FIG. 4, the opening in the central web of the closure may be of the same size, slightly wider and taller than the seam. Any clearance is caulked, as described later. The bottom flange of the closure, however, must be cut parallel to the seams. Because it is easy to cut the bottom flange with snips, and because the bottom cuts may have to be made at varying angles, we prefer to do this manually with metal snips. It is not practical, however, to attempt to cut the holes in the central web manually. We have therefore designed a special tool for this task. An exploded view of the tool is shown in FIG. 8.

Figure 9:
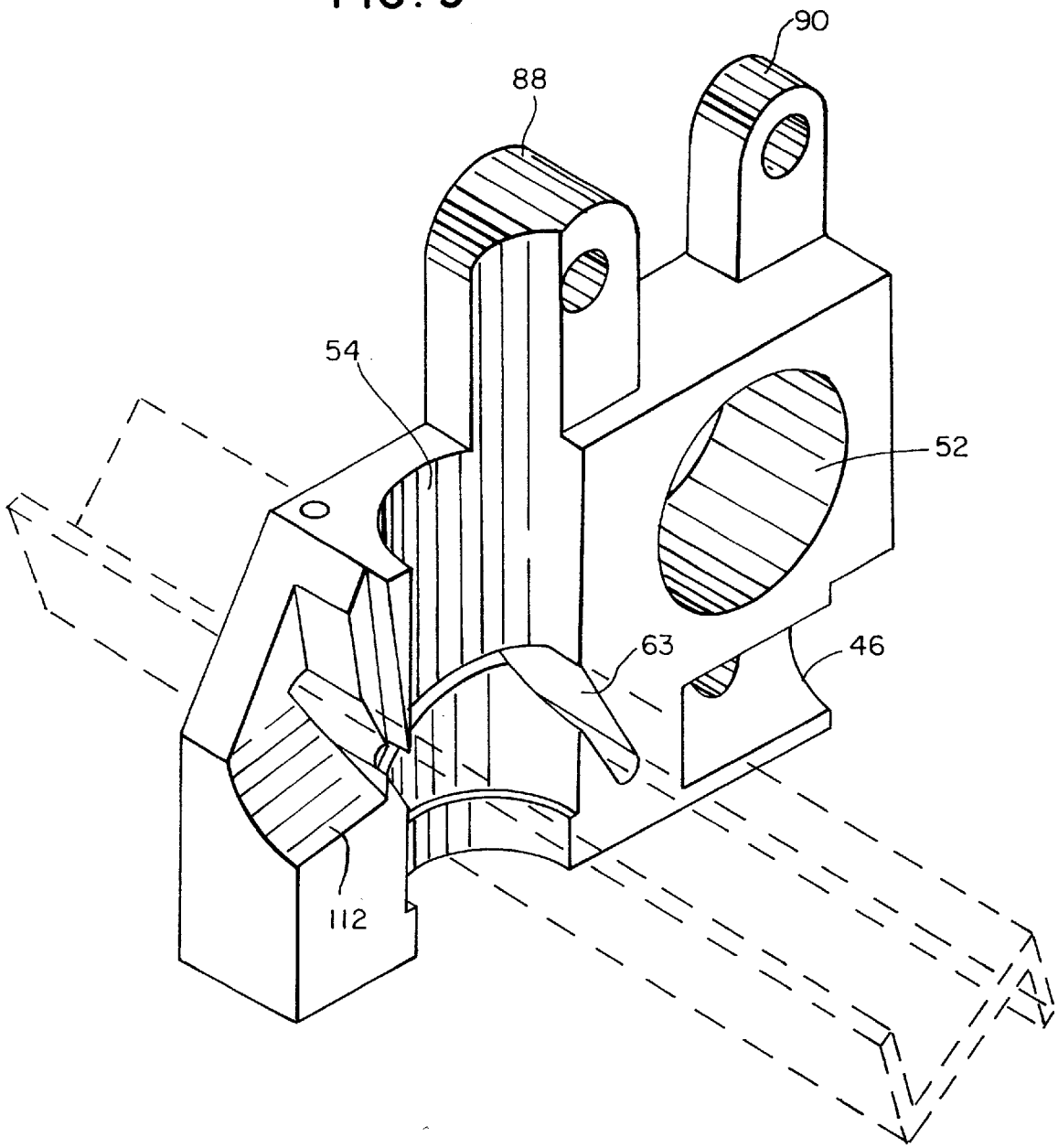
FIG. 9 is a sectional view, on a vertical plane, showing one half of the body of the tool.

The tool 40 comprises a body 42 with a flat bottom surface. A long lower handle 44 is secured in a hole 46 (FIG. 9) at the right end of the body by means of a spring pin 48 (FIG. 8). The body has a horizontal through-bore 52 above the pin 48, and a non-intersecting vertical blind bore 54 to the left. A die 55 is secured at the bottom of the bore 54 by a set screw 56. It is prevented from rotating in the bore by means of a pin 58 which rides in the vertical slot 60 on the far side of the die.

The "Z"-shaped upper surface 62 of the die is aligned with the bottom of "Z"-shaped slot 63 in the tool body, and both conform to the shape of the channel. The flat side of the cavity coincides with the die's valley 66.

The punch 68 is shaped to slide within the die's cavity 64. It is formed integrally with an intermediate collar 70 and a push rod 72. The punch is prevented from rotating by a pin 74 riding in a slot 76 in the punch's collar. The pushrod is driven downward, during operation, by a rocker arm 78. The pushrod is biased upward—so that the punch normally is withdrawn from the die and does not obstruct the "Z"-shaped hole 63—by a compression spring 80 coaxial with the pushrod. The spring rests on a plate 82 affixed to the body by screws, not shown. At the top of the pushrod, the spring is retained by a washer 84, held in place by a keeper 86 inserted in a circumferential groove at the top of the push rod.

Four lugs 88,90, each having a horizontal hole at its upper end, project from the top surface of the body. The forward lugs 88 receive a pin 92 that passes through the forward round hole 94 in the rocker arm, providing a pivot axis. The rear lugs receive a pin 96 that provides a pivot axis for a pair of links 98 secured on either side of the upper handle 100 by three pins 102 threaded internally to receive retaining screws 104 at either end. A third dowel pin 106 connects the holes 108 at the forward ends of the links 98 to the elongated hole 110 in the rocker arm.

A cutout 112 at the forward end of the body allows one to see a portion of the channel member inserted into the tool, so that the member can be accurately positioned prior to punching.

Figure 3:
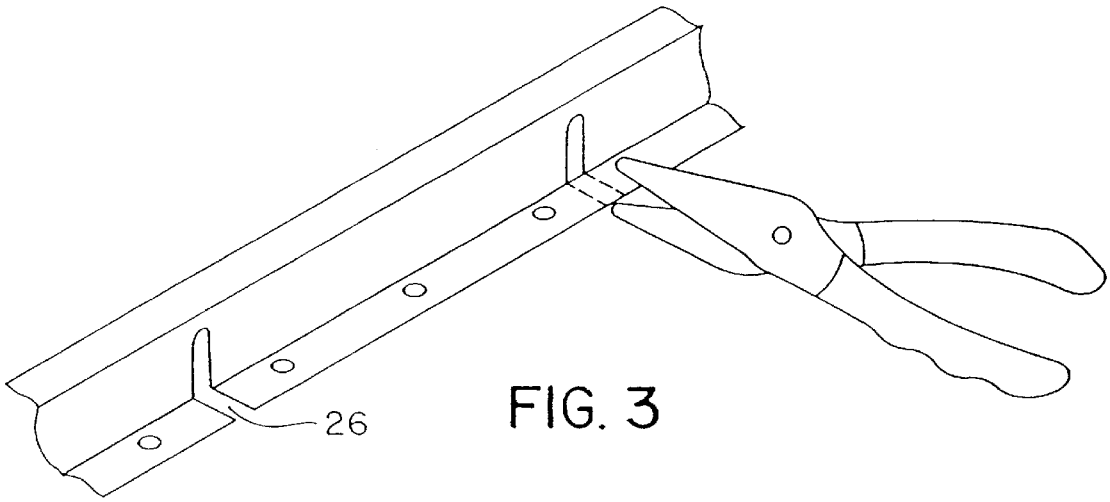
FIG. 3 show the slots of FIG. 2 being extended perpendicularly across the bottom flange with hand snips.

In use, the tool body is set on a flat surface, and the "Z"-member is inserted into the "Z"-slot, its central web sliding over the face of the die. Once the intended location of the hole in the "Z"-member has been accurately located over the die, the handles are brought together to punch the hole. Thereafter, the handles are spread to release the "Z"-member, and the remaining holes may be similarly punched. The holes have a flat bottom, coincident with the bottom of the web, and a rounded top. To complete the notch, the bottom flange is cut with metal snips (FIG. 3 or FIG. 4) along parallel lines leading to the bottom corners of the hole. The angle of these cuts must correspond to the angle of intersection between the seams and the closure.

Once the closure has been notched, it is placed on the roof so that the seams pass through the notches. A strip of weather sealing material will have been placed on the upper surface of the roof already, providing a gasket between the closure and the roof. Now, fasteners are placed through the holes in the closure, and are driven through the roof panels. Finally, any spaces between the seams and the notches are caulked.

Inasmuch as the invention is subject to variations and modifications, it is intended that the drawings and the foregoing description shall be interpreted as merely illustrative of the invention defined by the claims that follow.

What is claimed is:

1. A tool for cutting holes in the central web of a "Z"-section metal member, said tool comprising a body, a die situated in the body, a punch aligned with the die, said die having a "Z"-shaped upper surface providing a seat for the "Z"-section metal member, said punch and die being aligned to intersect the central web of the "Z"-section member, and means for driving said punch into said die.

2. The invention of claim 1, wherein the driving means comprises a pair of elongate handles, one being secured to said body, and one being pivotally connected to said body at a first pivot axis, a rocker arm connected to said body at a second pivot axis, said rocker arm having one end for driving the punch, and an opposite end driven by an upper one of said handles.

3. The invention of claim 2, wherein the body has a "Z"-shaped slot, whereby the channel member may be inserted to the tool, sliding over the upper face of the die.

4. The invention of claim 3, wherein the body has a cutout at its forward end, intersecting the "Z"-shaped slot, whereby one can observer marks made on the channel and thereby accurately position the channel for punching.

5. The invention of claim 1, wherein the punch includes a pushrod at is upper end, and the body includes a plate through which the push rod passes, a spring above the plate for retracting the punch, a spring retainer above the spring, and a keeper for maintaining the retainer and the spring in position around the push rod, whereby the punch is normally retracted from said die.

* * * * *